US005423236A

United States Patent [19]

Bickler

[11] Patent Number: 5,423,236

[45] Date of Patent: Jun. 13, 1995

[54] ADJUSTABLE SPREADING LOCKING PLIERS

[75] Inventor: Donald B. Bickler, Temple City, Calif.

[73] Assignee: California Institute of Technology, Pasadena, Calif.

[21] Appl. No.: 155,439

[22] Filed: Nov. 22, 1993

[51] Int. Cl.[6] ..... B25B 7/12

[52] U.S. Cl. ..... 81/302; 81/418; 81/426

[58] Field of Search ..... 81/302, 367, 368, 418, 81/426, 487

[56] References Cited

U.S. PATENT DOCUMENTS 2,050,167 8/1936 Demmer ..... 81/302 X
2,595,989 5/1952 Smeltz ..... 81/302 X
5,062,191 11/1991 Carr ..... 81/302 X

*Primary Examiner*—James G. Smith
*Attorney, Agent, or Firm*—Robert M. Wallace; Michael L. Keller

[57] ABSTRACT

The spreading pliers of the invention include a pair of handles, self-locking linkage which rotatably couples together the pair of handles, the self-locking linkage including a shank rotatably coupled to the ends of both handles at respective pivot points thereon, a first plier end connected to the shank and a second plier end connected to one of the handles, one of the first and second plier ends permitting the other for pass therebetween to an unspread position, the self-locking linkage rotating the first and second plier ends away from one another as the handles are squeezed together to a spread position.

6 Claims, 2 Drawing Sheets

ADJUSTABLE SPREADING LOCKING PLIERS

BACKGROUND OF THE INVENTION

1. Origin of the Invention

The invention described herein was made in the performance of work under a NASA contract, and is subject to the provisions of Public Law 96-517 (35 USC 202) in which the Contractor has elected to retain title.

2. Technical Field

The invention relates to adjustable spreading pliers.

BACKGROUND OF THE INVENTION

There is a need for spreading pliers with a locking mechanism to hold the pliers in a spreading mode. Such a tool is needed, for example, for reaching into a hollow tube structure to pressure bond sensor elements or other mechanical devices to the interior surface of the hollow tube structure. It would be useful also for forcing two surfaces apart or to hold them apart at a desired distance.

SUMMARY OF THE DISCLOSURE

The spreading pliers of the invention include a pair of handles, self-locking linkage which rotatably couples together the pair of handles, the self-locking linkage including a shank rotatably coupled to the ends of both handles at respective pivot points thereon, a first plier end connected to the shank and a second plier end connected to one of the handles, one of the first and second plier ends permitting the other for pass therebetween to an unspread position, the self-locking linkage rotating the first and second plier ends away from one another as the handles are squeezed together to a spread position.

DETAILED DESCRIPTION OF THE PREFERRED EMBODIMENT

Figure 1:
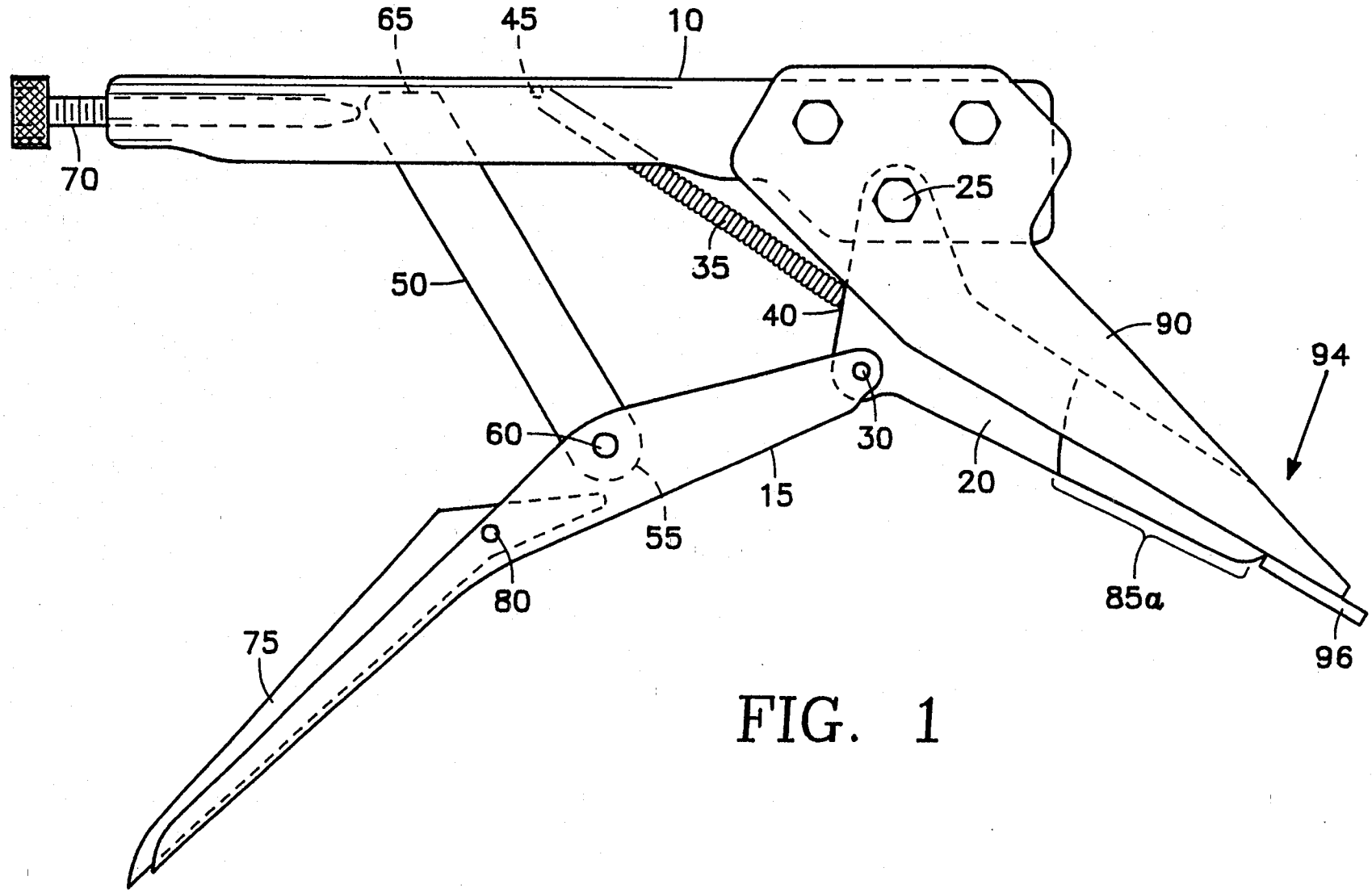
FIG. 1 is a side view of one embodiment of the spreading pliers of the invention in the closed position.
Figure 2:
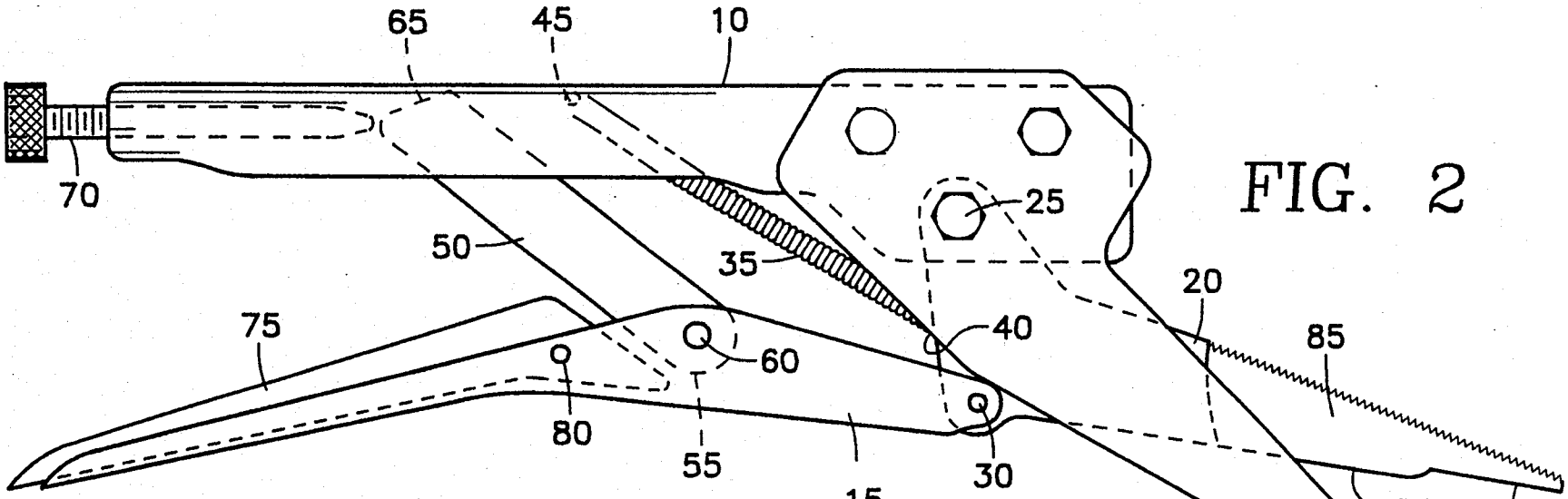
FIG. 2 is a side view of the spreading pliers of FIG. 1 in an open position.

Referring to FIGS. 1 and 2, a pair of handles 10, 15 of conventional self-locking pliers are rotatably linked together by a shank 20 at a pivot point 25 on the handle 10 and at a pivot point 30 on the handle 15. A spring 35 links the shank 20 to the handle 10 at spring attachment points 40, 45 in the conventional manner. A throw adjustment arm 50 has one of its ends 55 rotatably fastened inside the handle 15 at a pivot point 60 and its other end 65 constrained to travel along a portion of length of the interior of the handle 10 in accordance with the position of a set screw 70, in the conventional manner. A conventional release latch 75 fastened in the interior of the handle 15 at a pivot point 80 unlocks the pliers by pushing against the throw adjustment arm 50 when rotated about the pivot point 80, in the well-known manner. The foregoing elements constitute the linkage conventional squeeze locking pliers.

Figure 3:
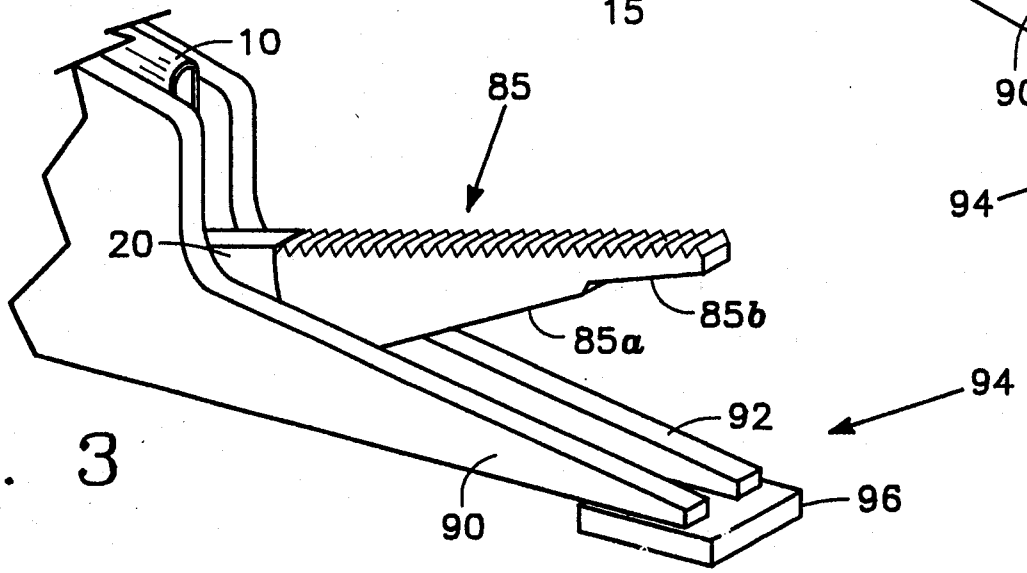
FIG. 3 is a perspective view of the spreading jaw and gripper portion of the pliers of FIGS. 1 and 2.

Referring to FIG. 3, in order to create spreading pliers using the foregoing conventional linkage elements, a jaw 85 is welded onto the end of the shank 20, while the arms 90, 92 of a gripper 94 are bolted onto the top of the handle 10. The base portion 85*a* of the jaw 85 fits between the arms 90, 92 and passes through them when the spreading pliers are moved from the closed position of FIG. 1 to the open position of FIG. 2. The gripper 94 includes a pad 96 welded onto the ends of the arms 90, 92. The end portion 85*b* of the jaw 85 nests on the pad 96 between the arms 90, 92 whenever the pliers are in the closed position of FIG. 1, thus opposing the spring 35 to arrest further movement of the handles 10, 15 following attainment of the closed position of FIG. 1. The pad 96 is on the side of the arms 90, 92 facing away from the jaw 85 while the teeth of the jaw 85 preferably face away from the gripper 94, so that the active surfaces of the pliers face outwardly. As the handles 10, 15 are squeezed together from their open position of FIG. 1 to their closed position of FIG. 2, the jaw 85 moves away from the gripper 94 until the open position of FIGS. 2 and 3 is attained and the handles are locked apart. The set screw 70 determines the distance between the gripper pad 96 and the jaw 85 in the locked position of FIG. 1.

It is the feature of the invention in which the jaw 85 passes through (between) the arms 90, 92 of the gripper 94 that facilitates the spreading action of the pliers. However, in an alternative embodiment, the same action can be realized by having the roles of the gripper and jaw reversed so that the gripper passes through the jaw.

In one of many possible applications, the jaw 85 engages the interior surface of a hollow tube structure while the gripper pad 96 holds a small device to be bonded against an opposite portion of the interior surface as the user squeezes the handles 10, 15 together and then leaves the pliers in the locked spread position of FIGS. 2 and 3, to which the user has previously adjusted the set screw 70. Later, the user rotates the release lever 75 and the pliers spontaneously unlock back to the closed position of FIG. 1.

While the invention has been described with reference to one implementation employing the linkage of a conventional pair of self-locking pliers, other linkage designs may be employed in carrying out the invention.

While the invention has been described in detail by specific reference to a preferred embodiment, it is understood that variations and modifications thereof may be made without departing from the true spirit and scope of the invention.

What is claimed is:

1. Spreading pliers, comprising:

a pair of handles;

self-locking linkage which rotatably couples together said pair of handles, said self-locking linkage including a shank rotatably coupled to one end of both handles at respective pivot points thereon;

a first plier end connected to said shank and a second plier end connected to one of said handles, one of said first and second plier ends permitting the other to pass therebetween to an unspread position of said plier ends; and said self-locking linkage comprising means for rotating said first and second plier ends away from one another as said handles are squeezed together to a spread position of said first and second plier ends.

2. The spreading pliers of claim 1 wherein said first plier end comprises a jaw and said second plier end comprises a gripper having a pair of arms between which said jaw passes between toward said unspread position.

3. The spreading pliers of claim 2 further comprising a gripper pad on which an end of said jaw rests in said unspread position.

4. The spreading pliers of claim 3 wherein said pad faces away from said jaw and said jaw has teeth facing away from said gripper.

5. The spreading pliers of claim 1 further comprising means for setting the distance between said first and second plier ends in said spread position.

6. The spreading pliers of claim 5 further comprising means for unlocking said pliers from said spread position.

* * * * *